US012735831B2

(12) United States Patent
Park et al.

(10) Patent No.: US 12,735,831 B2
(45) Date of Patent: Sep. 15, 2026

(54) CLOTHES TREATMENT APPARATUS

(71) Applicant: LG Electronics Inc., Seoul (KR)

(72) Inventors: Sunghoo Park, Seoul (KR); Youngjin Doh, Seoul (KR); Hyoungsup Park, Seoul (KR)

(73) Assignee: LG Electronics Inc., Seoul (KR)

( * ) Notice: Subject to any disclaimer, the term of this patent is extended or adjusted under 35 U.S.C. 154(b) by 54 days.

(21) Appl. No.: 18/608,518

(22) Filed: Mar. 18, 2024

(65) Prior Publication Data

US 2024/0218586 A1 Jul. 4, 2024

Related U.S. Application Data

(63) Continuation of application No. 17/492,961, filed on Oct. 4, 2021, now Pat. No. 11,965,281, which is a (Continued)

(30) Foreign Application Priority Data

Dec. 19, 2014 (KR) ..... 10-2014-0184452

(51) Int. Cl.
*D06F 58/20* (2006.01)
*D06F 34/14* (2020.01)
(Continued)

(52) U.S. Cl.
CPC ..... *D06F 58/203* (2013.01); *D06F 34/14* (2020.02); *D06F 58/206* (2013.01); *D06F 58/34* (2020.02);
(Continued)

(58) Field of Classification Search
CPC ..... D06F 58/10; D06F 73/02
See application file for complete search history.

(56) References Cited

U.S. PATENT DOCUMENTS 1,129,419 A 2/1915 Noller
2,095,370 A 10/1937 Reama et al.
(Continued)

FOREIGN PATENT DOCUMENTS

CN 101415879 4/2009
CN 102011296 4/2011
(Continued)

OTHER PUBLICATIONS

Office Action in U.S. Appl. No. 17/701,366, mailed on Apr. 24, 2024, 12 pages.
(Continued)

*Primary Examiner* — Spencer E. Bell
(74) *Attorney, Agent, or Firm* — Fish & Richardson P.C.

(57) ABSTRACT

A clothes treatment apparatus includes a cabinet, a door, and a steam unit. The clothes treatment apparatus further includes a heat pump unit that is located in the cycle chamber and that is configured to circulate and condition air in the treatment chamber. The clothes treatment apparatus further includes a water supply tank that is installed in the tank installation space, that is connected to the steam unit, and that is configured to supply water to the steam unit. The clothes treatment apparatus further includes a drainage tank that is separably installed in the tank installation space, that is configured to store condensed water generated in at least one of the treatment chamber or the heat pump unit. The clothes treatment apparatus further includes a water supply level sensor. The clothes treatment apparatus further includes a drainage level sensor.

10 Claims, 8 Drawing Sheets

Related U.S. Application Data continuation of application No. 14/972,619, filed on Dec. 17, 2015, now Pat. No. 11,313,071.

(51) Int. Cl.

| | |
|---|---|
| ***D06F 58/10*** | (2006.01) |
| ***D06F 58/24*** | (2006.01) |
| ***D06F 58/34*** | (2020.01) |
| ***D06F 73/02*** | (2006.01) |
| ***D06F 103/58*** | (2020.01) |
| ***D06F 103/62*** | (2020.01) |
| *D06F 103/18* | (2020.01) |

(52) U.S. Cl.

CPC ..... *D06F 73/02* (2013.01); *D06F 58/10* (2013.01); *D06F 58/20* (2013.01); *D06F 58/24* (2013.01); *D06F 2103/18* (2020.02); *D06F 2103/58* (2020.02); *D06F 2103/62* (2020.02)

(56) References Cited

U.S. PATENT DOCUMENTS

| | | | |
|---|---|---|---|
| 2,620,576 | A | 12/1952 | Stevenson et al. |
| 3,421,238 | A | 1/1969 | Brinker |
| 5,743,034 | A | 4/1998 | Debourg et al. |
| 2003/0104962 | A1 | 6/2003 | Verherbrugghen et al. |
| 2004/0025368 | A1 | 2/2004 | Gerhard et al. |
| 2005/0081574 | A1 | 4/2005 | Lyn et al. |
| 2006/0000111 | A1 | 1/2006 | Cho et al. |
| 2008/0223084 | A1 | 9/2008 | Kuwabara |
| 2009/0228156 | A1 | 9/2009 | Hong et al. |
| 2009/0241367 | A1 | 10/2009 | Yoo et al. |
| 2010/0031581 | A1 | 2/2010 | Kang et al. |
| 2010/0236091 | A1 | 9/2010 | Dittmer et al. |
| 2011/0174022 | A1 | 7/2011 | Ryu et al. |
| 2012/0144878 | A1 | 6/2012 | Acharya et al. |
| 2012/0292346 | A1 | 11/2012 | Watson et al. |
| 2013/0117944 | A1 | 5/2013 | Moon et al. |
| 2014/0238086 | A1 | 8/2014 | Choi et al. |
| 2014/0317948 | A1 | 10/2014 | Lee et al. |
| 2014/0360530 | A1 | 12/2014 | Pers et al. |

FOREIGN PATENT DOCUMENTS

| | | | |
|---|---|---|---|
| CN | 202849828 | | 4/2013 |
| CN | 203049334 | | 7/2013 |
| CN | 203159994 | | 8/2013 |
| CN | 103771563 | | 5/2014 |
| CN | 203583620 | | 5/2014 |
| CN | 203700812 | | 7/2014 |
| CN | 203715965 | | 7/2014 |
| DE | 8805385 | | 6/1989 |
| DE | 202012104276 | | 4/2013 |
| EP | 1659207 | | 5/2006 |
| EP | 2508668 | | 10/2012 |
| EP | 2765232 | A1 | 8/2014 |
| GB | 2511432 | | 9/2014 |
| JP | H01-299598 | | 12/1989 |
| JP | H02-116399 | | 5/1990 |
| JP | 2001-272109 | | 10/2001 |
| JP | 2008-080914 | | 4/2008 |
| JP | 2010-253059 | | 11/2010 |
| JP | 2013-103136 | | 5/2013 |
| JP | 2014-030776 | | 2/2014 |
| JP | 2014-150814 | | 8/2014 |
| JP | 2017-538531 | | 12/2017 |
| KR | 20-0127763 | | 12/1998 |
| KR | 10-2008-0107788 | | 12/2008 |
| KR | 10-2009-0105119 | | 10/2009 |
| KR | 10-2010-0007342 | | 1/2010 |
| KR | 10-2010-0007343 | | 1/2010 |
| KR | 10-1038121 | | 5/2011 |
| KR | 10-2011-0067834 | | 6/2011 |
| KR | 10-2011-0067893 | | 6/2011 |
| KR | 10-2011-0106834 | | 9/2011 |
| KR | 10-2011-0125983 | | 11/2011 |
| KR | 10-2013-0053216 | | 5/2013 |
| KR | 10-2014-0016093 | | 2/2014 |
| KR | 10-2014-0108454 | | 9/2014 |
| KR | 30-0766603 | B | 10/2014 |
| KR | 10-2014-0127503 | | 11/2014 |
| WO | WO 2007/126225 | | 11/2007 |
| WO | WO 2007/137860 | | 12/2007 |
| WO | WO 2009/020313 | | 2/2009 |
| WO | WO 2009/123407 | | 10/2009 |
| WO | WO 2010/008162 | | 1/2010 |

OTHER PUBLICATIONS

Office Action in U.S. Appl. No. 18/351,088, mailed on Jul. 5, 2024, 14 pages.

Office Action in U.S. Appl. No. 18/473,756, mailed on Jul. 5, 2024, 10 pages.

Extended European Search Report in European Appln. No. 19202940.3, mailed on May 15, 2020, 6 pages.

Extended European Search Report in European Appln. No. 19202942.9, mailed on May 5, 2020, 10 pages.

Extended European Search Report in European Appln. No. 19202943.7, mailed on May 15, 2020, 6 pages.

Extended European Search Report issued in European Appln. No. 15201376.9 mailed on Apr. 25, 2016, 10 pages.

International Search Report and Written Opinion in International Appln. No. PCT/KR2015/013941, mailed Apr. 15, 2016, 13 pages.

Notice of Allowance in Korean Appln. No. 10-2019-0140362, mailed on Jun. 8, 2020, 2 pages (with English translation).

Notice of Allowance in Korean Appln. No. 10-2019-0140363, mailed on Jun. 8, 2020, 2 pages (with English translation).

Notice of Allowance in Korean Appln. No. 10-2023-0003599, mailed on Oct. 10, 2023, 14 pages (with English translation).

Office Action in Chinese Appln. No 201910126014.0, mailed on Nov. 12, 2021, 22 pages (with English translation).

Office Action in Chinese Appln. No. 201510962747.X, mailed on Jun. 23, 2017, 15 pages (with English translation).

Office Action in Chinese Appln. No. 201910125898.8, mailed on Aug. 26, 2020, 21 pages (with English translation).

Office Action in Chinese Appln. No. 201910125898.8, mailed on Jun. 9, 2021, 20 pages (with English translation).

Office Action in Chinese Appln. No. 201910126014.0, mailed on Aug. 3, 2020, 26 pages (with English translation).

Office Action in Japanese Appln. No. 2019-106312, mailed on Sep. 1, 2020, 5 pages (with English translation).

Office Action in Japanese Appln. No. 2019-106331, mailed on Sep. 1, 2020, 6 pages (with English translation).

Office Action in Korean Appln. No. 10-2014-0184452, mailed on Apr. 27, 2021, 17 pages (with English translation).

Office Action in U.S. Appl. No. 16/805,198, mailed on Jul. 7, 2022, 14 pages.

Office Action in U.S. Appl. No. 14/972,619, mailed on Sep. 25, 2020, 16 pages.

Office Action in U.S. Appl. No. 17/492,961, mailed on Jan. 19, 2023, 15 pages.

Office Action in U.S. Appl. No. 17/494,343, mailed on Jan. 30, 2023, 14 pages.

Office Action in U.S. Appl. No. 17/701,373, mailed on Feb. 6, 2023, 18 pages.

Office Action in U.S. Appl. No. 18/473,756, mailed on Nov. 20, 2024, 11 pages.

Office Action in Korean Appln. No. 10-2024-0134797, mailed on Jul. 10, 2026, 12 pages (with English translation).

CLOTHES TREATMENT APPARATUS

CROSS-REFERENCE TO RELATED APPLICATIONS

This application is a continuation of U.S. application Ser. No. 17/492,961, filed on Oct. 4, 2021, which is a continuation of U.S. application Ser. No. 14/972,619, filed on Dec. 17, 2015, now U.S. Pat. No. 11,313,071, which claims the priority benefit of Korean Patent Application No. 10-2014-0184452, filed on Dec. 19, 2014, the disclosures of which are incorporated herein by reference.

TECHNICAL FIELD

The present disclosure relates to a clothes treatment apparatus.

BACKGROUND

Clothes treatment apparatuses are apparatuses that treat clothes, e.g., wash and dry clothes and smooth wrinkles in clothes, at home or at laundromats.

Clothes treatment apparatuses may be classified into a washer for washing clothes, a dryer for drying clothes, a washer/dryer having both a washing function and a drying function, a refresher for refreshing clothes, and a steamer for removing unnecessary wrinkles in clothes.

The refresher is an apparatus that keep clothes comfortable and fresh. The refresher functions to dry clothes, to supply fragrance to clothes, to prevent the occurrence of static electricity in clothes, or to remove wrinkles from clothes.

The steamer is an apparatus that supplies steam to clothes in order to remove wrinkles from the clothes. Unlike a general iron, the steamer removes wrinkles from the clothes without directly applying heat to the clothes.

SUMMARY

According to an innovative aspect of the subject matter described in this application, a clothes treatment apparatus including a cabinet that is partitioned into a treatment chamber that is configured to receive clothes, a cycle chamber that is configured to house machinery, and a tank installation space that is configured to house a removable tank; a door that is configured to open and close at least a portion of the cabinet; a steam unit that is located in the cycle chamber and that is configured to supply steam to the treatment chamber; a heat pump unit that is located in the cycle chamber and that is configured to circulate and condition air in the treatment chamber; a water supply tank that is installed in the tank installation space, that is connected to the steam unit, and that is configured to supply water to the steam unit; a drainage tank that is separably installed in the tank installation space, that is configured to store condensed water generated in at least one of the treatment chamber or the heat pump unit; a water supply level sensor that is located in the water supply tank and that is configured to sense a water level of the water supply tank; and a drainage level sensor that is located in the drainage tank and that is configured to sense a water level of the drainage tank.

The clothes treatment apparatus may include one or more of the following optional features. The clothes treatment apparatus further includes a partition plate that is configured to partition the cabinet into an upper interior part that includes the treatment chamber and a lower interior part that includes the cycle chamber; and a tank module frame that is configured to partition the lower interior part into a front interior part and a rear interior part that includes the tank installation space. The tank installation space is configured to face the door. The water supply tank is adjacent to the drainage tank. The clothes treatment apparatus further includes a tank support bar that is located between the tank installation space and the door, wherein at least one of the water supply tank or the drainage tank is located on the tank support bar.

The at least one of the water supply tank or the drainage tank includes a tank support end that is concave and that is configured to engage with the tank support bar. Based on the at least one of the water supply tank or the drainage tank being placed on the tank support bar, the tank support bar and a front of the at least one of the water supply tank or the drainage tank are configured to form a continuous surface with the tank support bar. An upper side of at least one of the water supply tank or the drainage tank is configured to reduce interference with the partition plate based on the upper side of the at least one of the water supply tank or the drainage tank being rounded. At least one of the water supply tank and the drainage tank includes a grip, the grip being concave and accessible from a front of the at least one of the water supply tank or the drainage tank.

The water supply level sensor includes a float cabinet that is fixed to the water supply tank; a float that is located in the float cabinet and that is configured to move up and down in the float cabinet based on the water level in the water supply tank; and a sensor that is located at the float cabinet and that is configured to magnetically sense the float. The sensor is installed in one of the cycle chamber or the tank installation space. A minimum amount of water that the water supply level sensor is configured to sense is sufficient to supply the steam unit for one cycle. The drainage level sensor includes a float cabinet that is fixed to the drainage tank; a float that is located in the float cabinet and that is configured to move up and down in the float cabinet based on the water level in the drainage tank; and a sensor that is located at the float cabinet and that is configured to magnetically sense the float.

The sensor is installed in one of the cycle chamber or the tank installation space. Based on the drainage level sensor sensing a maximum water level, sufficient water capacity remains in the drainage tank to store an amount of condensed water that is generated during one cycle of one of the treatment chamber or the heat pump unit. The water supply tank or the drainage tank includes a tank body that defines an opening at a front of the tank body, wherein an upper surface of the tank body that is configured to be inserted into the tank installation space is round; a tank cover that is coupled to the front of the tank body and that includes a concave grip; and a check valve that is located in the tank body and that is configured to open and close a flow channel that extends from the tank body to an outside of the clothes treatment apparatus.

The clothes treatment apparatus further includes a tank support bar that is located between the tank installation space and the door, where at least one of the water supply tank or the drainage tank is configured to engage the tank support bar with a tank support end of the at least one of the water supply tank or the drainage tank being received on an upper side of the tank support bar, and wherein the tank support end is concave. Based on water supply tank including the check valve, the check valve is located at a lower side of the tank body, is connected to the steam unit, and is configured to supply water to the steam unit. The clothes treatment apparatus further includes a water hole that is located at an upper side of the tank body; and a water hole cover that is configured to open and close the water hole. The water supply tank or the drainage tank further includes a float installation part that is located in the tank body, where the tank body and the tank cover are manufactured by insert injection molding using die slide injection, and where the water supply level sensor or the drainage level sensor is coupled to the float installation part by insert injection molding using die slide injection.

It is an object of the subject matter disclosed in this application to provide a clothes treatment apparatus that is capable of directly sensing the level of water stored in a tank.

It is another object of the subject matter disclosed in this application to provide a clothes treatment apparatus that is capable of enabling a user to immediately check fir the deficiency of water during the operation of the clothes treatment apparatus.

DETAILED DESCRIPTION

Figure 1:
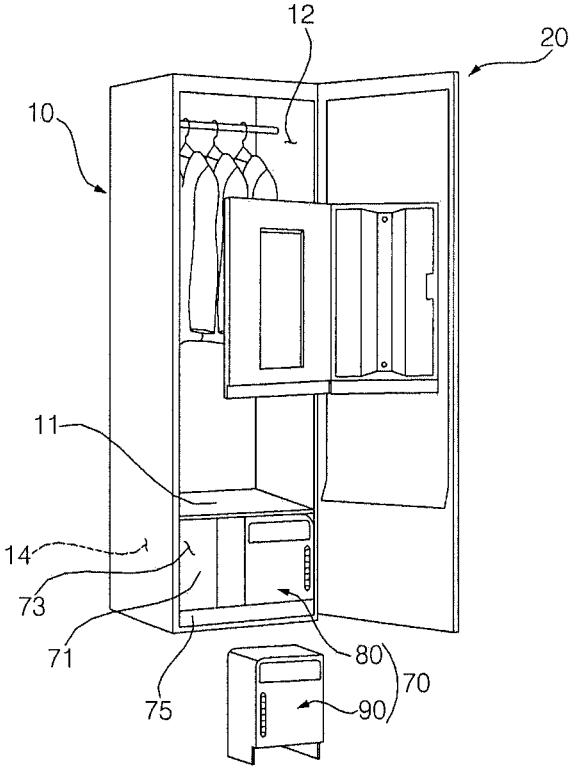
FIG. 1 is a perspective view of an example clothes treatment apparatus.
Figure 2:
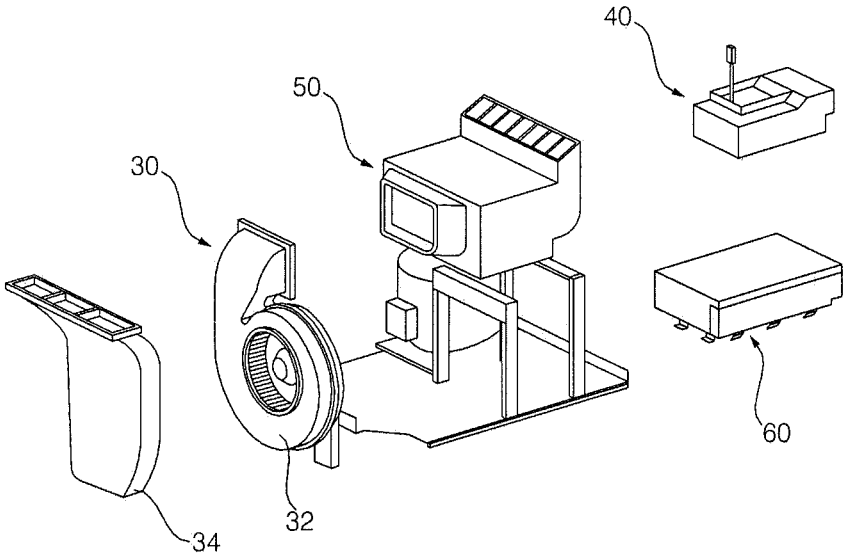
FIG. 2 is an exploded perspective view of an example cycle assembly.
Figure 3:
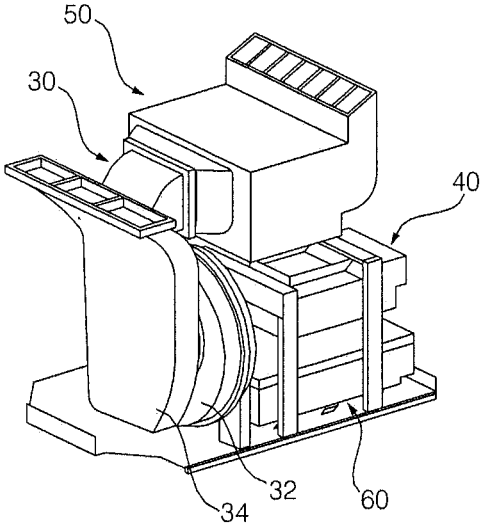
FIG. 3 is a perspective view of an example cycle assembly.
Figure 4:
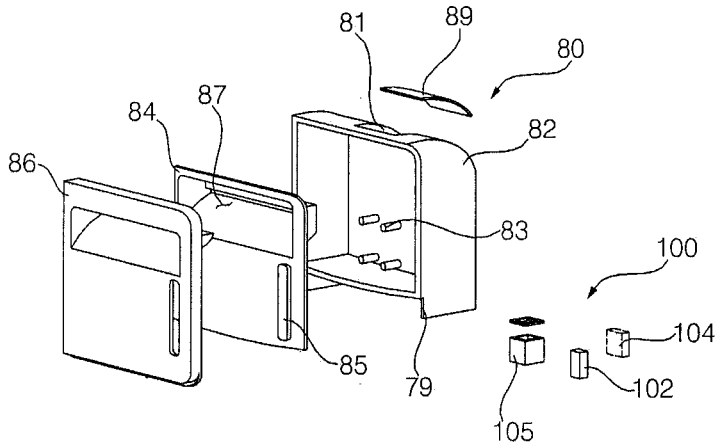
FIG. 4 is an exploded perspective view of an example water supply tank.
Figure 5:
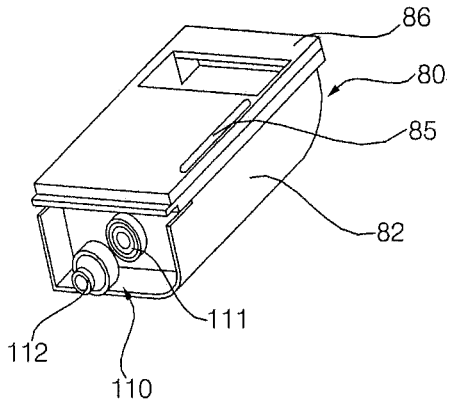
FIG. 5 is a partially exploded perspective view of an example water supply tank.
Figure 6:
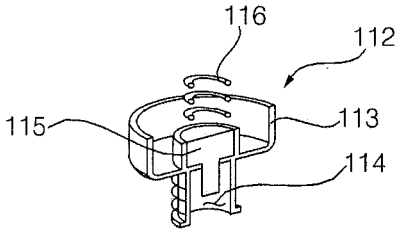
FIG. 6 is a sectional perspective view of an example check assembly.
Figure 7:
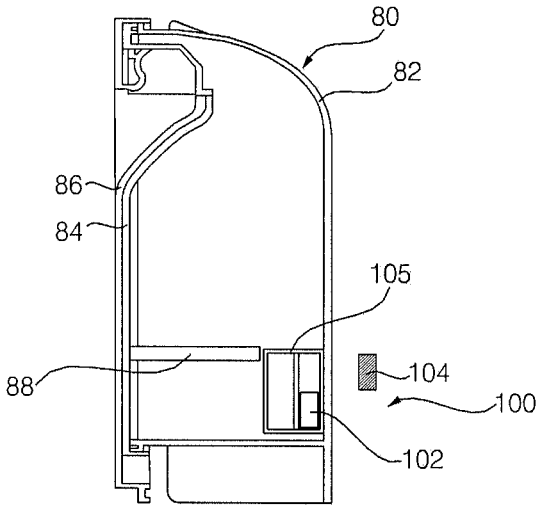
FIG. 7 is a side sectional view of an example water supply tank.
Figure 8:
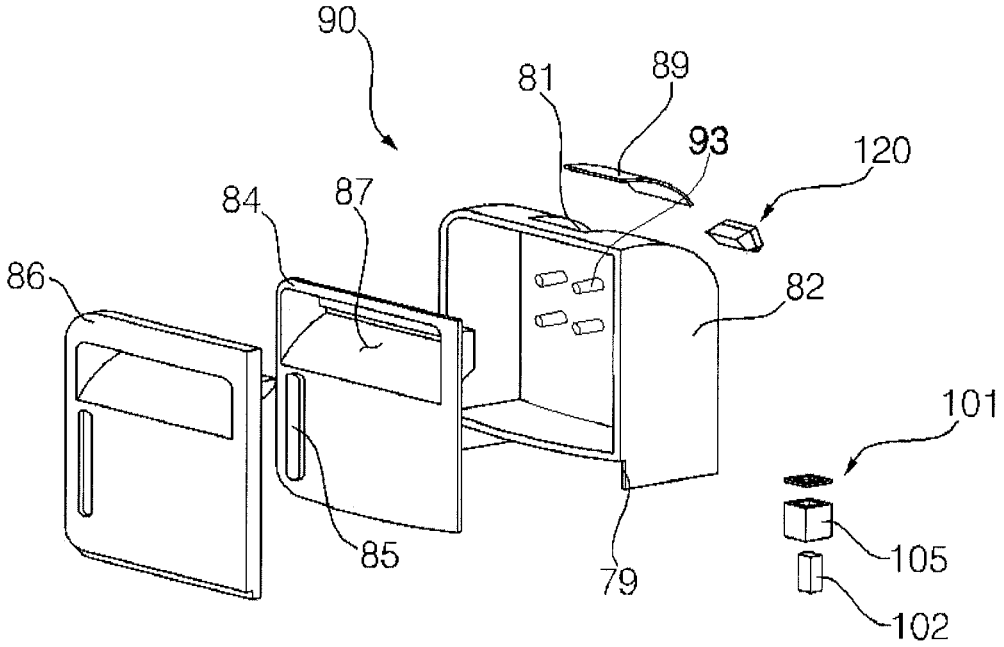
FIG. 8 is a perspective view of an example drainage tank.
Figure 9:
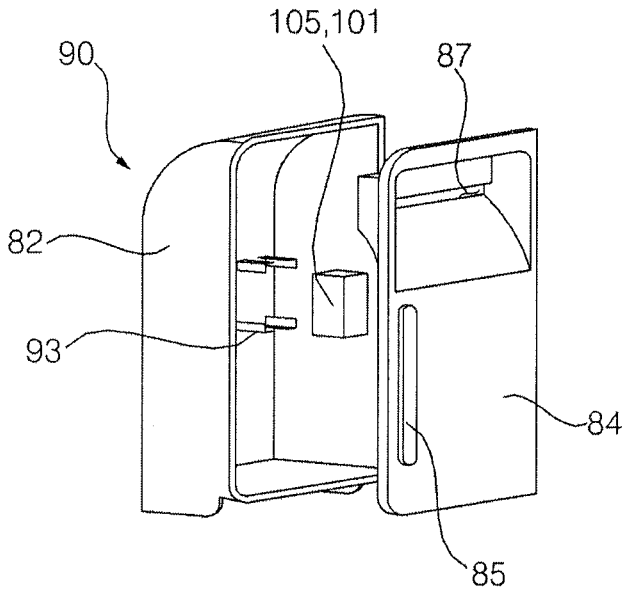
FIG. 9 is a partially exploded perspective view of an example drainage tank.
Figure 10:
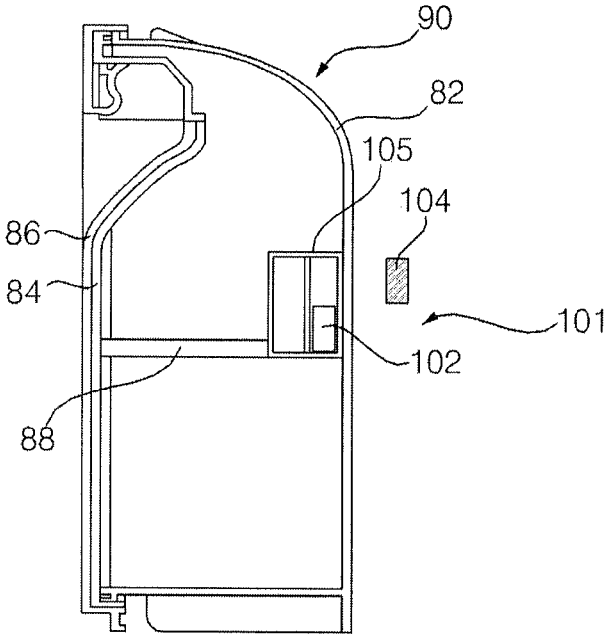
FIG. 10 is a side sectional view of an example drainage tank.
Figure 11:
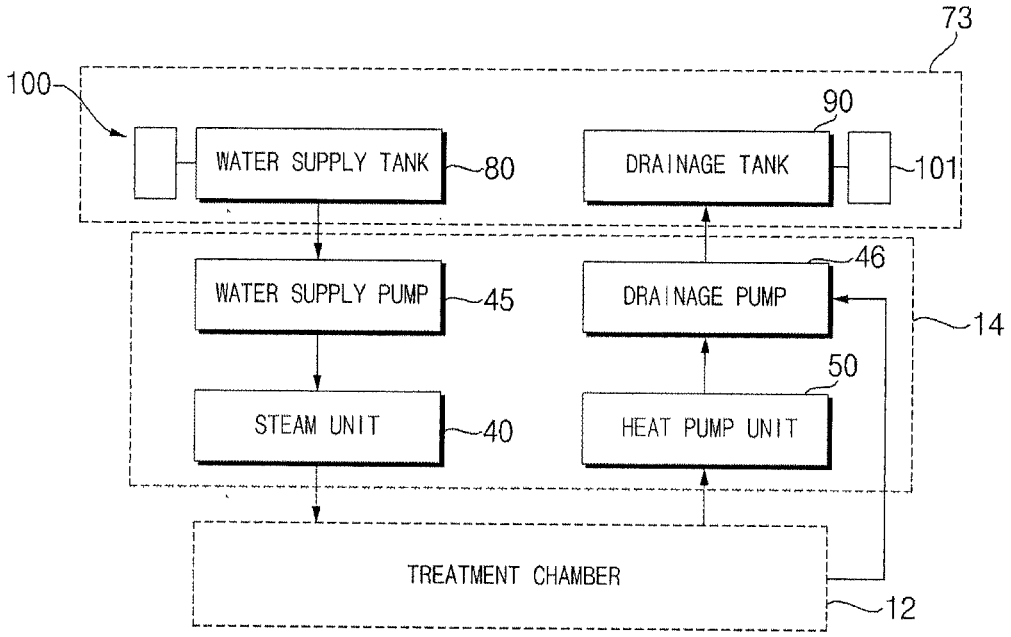
FIG. 11 is a block diagram of an example clothes treatment apparatus.

FIGS. 1 and 11 illustrate example clothes treatment apparatuses. FIGS. 2 and 3 illustrate example cycle assemblies. FIGS. 4, 5, and 7 illustrate example water supply tanks. FIG. 6 illustrates an example check assembly. FIGS. 8, 9, and 10 illustrate example drainage tanks.

In some implementations, the clothes treatment apparatus includes a cabinet 10 and a door 20 configured to open and close the front of the cabinet 10.

The interior of the cabinet 10 is partitioned into upper and lower interior parts by a partition plate 11. A treatment chamber 12, in which clothes are hung, is defined in the interior of the cabinet 10 above the partition plate 11. A cycle chamber 14, in which machinery is installed, is defined in the interior of the cabinet 10 below the partition plate 11.

Clothes are hung in the treatment chamber 12. In the treatment chamber 12, wrinkles in the clothes are smoothed, or the clothes are deodorized, by the circulation of steam or air.

A blowing unit 30 for circulating air in the treatment chamber 12, a steam unit 40 for supplying steam into the treatment chamber 12, a heat pump unit 50 for conditioning air, e.g., cooling, heating, or dehumidification, in the treatment chamber 12, and a control unit 60 for controlling the respective units 30, 40, and 50 are installed in the cycle chamber 14.

In some implementations, an assembly of machinery, including the blowing unit 30, the steam unit 40, the heat pump unit 50, and the control unit 60, which are required to perform respective cycles of the clothes treatment apparatus, is defined as a cycle assembly.

The blowing unit 30 includes a blowing fan 32 and an inlet duct 34.

The inlet duct 34 is installed at the suction side of the blowing fan 32 to guide air in the treatment chamber 12 to the blowing fan 32.

The blowing fan 32 is rotated to blow air. The blowing fan 32 suctions air from the treatment chamber 12, and discharges the suctioned air to the heat pump unit 50.

When the steam unit 40 is powered on, heat is generated from the steam unit 40. The steam unit 40 converts water supplied from a water supply tank 80, which will be described hereinafter, into steam. The generated steam is discharged into the treatment chamber 12.

In some implementations, a flow channel is defined such that the steam flows into the treatment chamber 12 via the heat pump unit 50.

The heat pump unit 50 constitutes a heat pump cycle including a compressor, a condenser, an evaporator, and an expansion valve. Based on the operation mode of the heat pump unit 50, cooled air or heated air may be discharged into the treatment chamber 12.

In some implementations, the heat pump unit 50 may dehumidify air supplied from the blowing unit 30.

A tank module 70 for storing water is installed in front of the cycle chamber 14. The tank module 70 includes a water supply tank 80 for supplying water to the steam unit 40 and a drainage tank 90 for gathering and storing condensed water that is generated in the treatment chamber 12.

Water from the water supply tank 80 flows to the steam unit 40 via a water supply pump 45.

Water that is condensed in the treatment chamber 12, flows to the lower side of the treatment chamber 12 due to gravity, and is then pumped to the drainage tank 90 by a drainage pump 46. Water that is condensed in the heat pump unit 50 also flows to the drainage tank 90 via the drainage pump 46.

The water supply pump 45 or the drainage pump 46 is controlled by the control unit 60.

In some implementations, a tank module frame 71 is installed in front of the inlet duct 34.

A tank installation space 73 is defined between the tank module frame 71 and the door 20. The tank module frame 71 is coupled to the partition plate 11 to isolate the cycle chamber 14 from the outside.

A tank support bar 75, which interferes with at least one selected from between the water supply tank 80 and the drainage tank 90, is installed in front of the tank installation space 73.

The tank support bar 75 prevents the water supply tank 80 or the drainage tank 90 from being unintentionally separated from the tank installation space 73. The tank support bar 75 supports the front of the water supply tank 80 and the front of the drainage tank 90.

When the door 20 is opened and closed, therefore, the water supply tank 80 and the drainage tank 90 are prevented from being separated from the tank installation space 73.

In some implementations, the lower end of the water supply tank 80 is placed on the upper end of the tank support bar 75, and the lower end of the drainage tank 90 is placed on the upper end of the tank support bar 75.

A tank support end 79, which interferes with the tank support bar 75, is formed on at least one selected from between the water supply tank 80 and the drainage tank 90.

The tank support end 79 is concavely recessed.

The front of the tank support bar 75 and the front of the water supply tank 80 may form a continuous surface due to the tank support end 79. In addition, the front of the tank support bar 75 and the front of the drainage tank 90 may form a continuous surface due to the tank support end 79

The water supply tank 80 and the drainage tank 90 are disposed in the tank installation space 73 such that the water supply tank 80 and the drainage tank 90 are arranged parallel to each other in rightward and leftward directions.

When the door 20 is opened, the water supply tank 80 and the drainage tank 90 are exposed to a user.

The water supply tank 80 and the drainage tank 90 may be withdrawn by the user.

The water supply tank 80 and the drainage tank 90 may be separated from the tank module frame 71. The water supply tank 80 and the drainage tank 90 may be separably mounted in the tank installation space 73.

The water supply tank 80 is connected to the steam unit 40 to supply water to the steam unit 40. The drainage tank 90 is connected to the treatment chamber 12 to store water discharged from the treatment chamber 12 or the heat pump unit 50.

The water supply tank 80 includes a tank body 82, which is open at the front thereof, a tank cover 84 coupled to the front of the tank body 82, a decorative cover 86 coupled to the tank cover 84, a water supply check valve 110 installed in the tank body 82 for opening and closing a flow channel connected with the steam unit 40, and a water supply level sensor 100 for sensing the level of water stored in the tank body 82.

The front of the tank body 82 is open. The water supply level sensor 100 is disposed in the tank body 82.

The upper end of the tank body 82 is round at the rear side thereof.

When the tank body 82 is separated, interference between the tank body 82 and the partition plate 11 is minimized.

The user may easily pull and withdraw the water tank 80, which is disposed at the lower side of the clothes treatment apparatus, due to the round shape of the tank body 82.

In some implementations, the water supply level sensor 100 includes a float 102 installed in the tank body 82 such that the float 102 can move upward and downward based on the level of water stored in the tank body 82, a float cabinet 105 installed in the tank body 82 in a state in which the float 102 is disposed in the float cabinet 105, and a sensor 104 installed at the tank module frame 71 to sense the float 102.

The float 102 has a magnet. The sensor 104 senses the magnetic force of the magnet.

The sensor 104 may be installed at the front or rear of the tank module frame 71.

The sensor 104 may be installed through the tank module frame 71.

Consequently, the sensor 104 may be located in any one selected from among the cycle chamber 14, the tank installation space 73, and the tank module frame 71.

The float 102, which is installed in the water supply tank 80, is flush with the sensor 104. When the level of water stored in the water supply tank 80 is lowered, the float 102 moves lower than the sensor 104. When the sensor 104 fails to sense the float 102, therefore, the control unit 60 outputs a water deficiency signal. Even when the water deficiency signal is output, it is possible to supply a sufficient amount of steam during a cycle that is currently being performed.

Since the sensor 104 constantly senses the float 102, the control unit 60 may determine whether the water supply tank 80 is mounted.

For example, when the water supply tank 80 is not mounted, or when water is deficient, the control unit 60 outputs a water deficiency signal.

When the user manipulates the clothes treatment apparatus in a state in which the water deficiency signal is output, therefore, the control unit 60 performs control such that the clothes treatment apparatus is not operated and outputs a water deficiency signal. At this time, the user may check the water supply tank 80.

A float installation part 83, at which the float 102 is installed, is formed at the inside of the tank body 82. The float cabinet 105 is installed at the float installation part 83. The float 102 may move upward and downward along the float cabinet 105 by buoyancy.

In some implementations, the float 102 is installed at the minimum level of water stored in the water supply tank 80, at which it is possible to supply an amount of steam corresponding to one cycle. Even when the sensor 104 fails to sense the float 102, and therefore the control unit 60 outputs a water deficiency signal, it is possible to supply an amount of steam corresponding to at least one cycle.

That is, even when a water deficiency signal is sensed during the supply of steam, it is possible to supply a sufficient amount of steam until a cycle that is currently being performed is completed.

The float cabinet 105, in which the float 102 is mounted, is manufactured by insert injection molding at the time of die slide injection (DSI) of the tank cover 84 and the tank body 82.

Die slide injection (DSI) is for blow molding or molding of thin products. DSI conveys various advantages in that no post-processing, such as adhesion or assembly, is necessary after injection molding, it is possible to adjust the thickness of a wall more easily than when blow molding or gas molding, it is possible to provide an excellent surface shape or high dimensional accuracy, and it is possible to perform DSI instead of double injection or blow molding.

The tank body 82 and the tank cover 84 are manufactured by insert injection molding using DSI. During the manufacture of the tank body 82 and the tank cover 84, the float cabinet 105 is installed in the tank body 82 and the tank cover 84 by insert injection molding. During the manufacture of the tank body 82 and the tank cover 84, the edge of the tank cover 84 is integrally coupled to the edge of the tank body 82.

The tank cover 84 has a window 85, through which the user may check the level of water in the tank body 82. In addition, a grip 87, into which the user may insert his/her hand in order to hold the tank cover 84, is concavely formed at the tank cover 84.

The grip 87 is formed at the tank cover 84 such that the grip 87 is concave from the front to the rear thereof.

A sensor fixing part 88 is formed at the inside of the tank cover 84. The sensor fixing part 88 protrudes from the inside of the tank cover 84. When the tank cover 84 and the tank body 82 are coupled to each other, the sensor fixing part 88 comes into tight contact with the float cabinet 105.

Since the sensor fixing part 88 tightly contacts the float cabinet 105, the float cabinet 105 is prevented from being separated from the float installation part 83.

The sensor fixing part 88 may be integrally formed with the tank cover 84.

The decorative cover 86 is formed to have a shape that is capable of covering the front of the tank cover 84. In addition, the decorative cover 86 is formed to have a shape corresponding to the shape of the tank cover 84.

A water hole 82 is formed at the upper side of the tank body 92. In addition, a water hole cover 89 for opening and closing the water hole 82 is disposed at the upper side of the tank body 92.

The water hole cover 89 is made of a flexible material exhibiting high elasticity. One end of the water hole cover 89 is fixed to the tank body 82, and the other end of the water hole cover 89 may be bent in order to open and close the water hole 82.

The water supply check valve 110 includes a check valve hole 111 formed at the lower side of the tank body 82 and a check assembly 112 coupled to the check valve hole 111 for regulating the water in the tank body 82.

The check assembly 112 includes a check housing 113 coupled into the check valve hole 111, the check housing 113 having a check flow channel 114, through which water flows into the check housing 113, a valve 115 disposed in the check housing 113 for opening and closing the check flow channel 114, and a check elastic member 116 disposed between the valve 115 and the tank body 82 for applying elastic force to the valve 115.

The small-diameter side of the valve 115 protrudes downward. When the valve 115 is placed on the tank module frame 71, the valve 115 may be pushed by the tank module frame 71, and may thus move upward. At this time, the check flow channel 114 is opened as the result of the movement of the valve 115. When the water supply tank 80 is separated from the tank module frame 71, the check flow channel 114 is closed by the elastic force of the check elastic member 116.

The drainage tank 90 is identical in function to the water supply tank 80. The drainage tank 90 is disposed alongside the water supply tank 80.

In the drainage tank 90, a drainage check valve 120 is installed at the rear side thereof, not at the lower side thereof, unlike the water supply tank 80.

The water supply tank 80 receives water through the water hole 81, and discharges water through the water supply check valve 110. The drainage tank 90 may receive condensed water through the drainage check valve 120, and may discharge condensed water through the water hole 81.

That is, the drainage check valve 120 of the drainage tank 90 may be disposed in a channel for receiving condensed water, not for discharging condensed water.

In some implementations, condensed water may fall into the drainage tank 90 through the water hole 81. In addition, condensed water may be automatically discharged through the drainage check valve 120.

Water that is condensed in the treatment chamber 12 and water that is condensed in the heat pump unit 50 are stored in the drainage tank 90.

A float installation part 93, at which the float cabinet 105 is installed, is formed in the drainage tank 90.

The float installation part 93 may be located at a height in the drainage tank 90 at which overflow does not occur even when an amount of condensed water that is generated during one cycle is stored therein.

That is, the float installation part 93 is located at a height in the drainage tank 90 at which overflow does not occur even when an amount of condensed water that is generated during one cycle is stored in the drainage tank 90.

When a drainage level sensor 101 of the drainage tank 90 senses a signal during the operation of the clothes treatment apparatus, therefore, the water in the drainage tank 90 does not overflow due to the condensed water that is additionally stored in the drainage tank 90.

The drainage level sensor 101 of the drainage tank 90 is located higher than the water supply level sensor 100 in the water supply tank 80.

The drainage level sensor 101 of the drainage tank 90 is identical in construction to the water supply level sensor 100 of the water supply tank 80. However, the drainage level sensor 101 of the drainage tank 90 is operated differently from the water supply level sensor 100 of the water supply tank 80.

For example, the sensor 104 of the drainage tank 90 does not sense the float 102 in a normal state. When the level of condensed water rises, the sensor 104 of the drainage tank 90 senses the float 102, which has been raised by buoyancy.

When the sensor 104 of the drainage tank 90 senses the float 102, the control unit 60 outputs a water drainage signal. When the water drainage signal is output, however, the overflow of condensed water does not occur during a cycle that is currently being performed.

As is apparent from the above description, the clothes treatment apparatus has the following effects.

It is possible to directly sense the amount of water stored in the water supply tank instead of estimating the amount of water stored in the water supply tank.

It is possible to sense the level of water stored in the water supply tank without delay.

It is possible to directly sense the level of water stored in the drainage tank without delay, thereby preventing water from overflowing the drainage tank.

In the clothes treatment apparatus, the water supply level sensor is installed at the level of water that is required to generate enough steam for at least one cycle. Consequently, it is possible to prevent the supply of water from being interrupted while steam is being generated.

In the clothes treatment apparatus, the drainage level sensor is installed at the level of water at which it is possible to store all of the water that is condensed during at least one cycle. Consequently, it is possible to prevent the condensed water from overflowing the drainage tank, or it is not necessary to drain the condensed water from the drainage tank, during the operation of the clothes treatment apparatus.

What is claimed is:

1. A clothes treatment apparatus comprising:

a cabinet;

a door disposed at a front of the cabinet and configured to open and close the cabinet;

a treatment chamber located inside the cabinet and configured to receive hung clothes, the treatment chamber being configured to be opened and closed by the door;

a cycle chamber located inside the cabinet and below the treatment chamber;

a steam unit disposed in the cycle chamber and configured to supply steam to the treatment chamber;

a heat pump disposed in the cycle chamber and configured to exchange heat with air in the treatment chamber;

a tank installation portion located inside the cabinet and disposed forward of the cycle chamber, the tank installation portion defining an opening at a front side thereof; and a water tank defining a water-storage space therein and configured to at least one of (i) supply water to the steam unit based on the water tank being connected to the steam unit or (ii) receive condensed water generated in the treatment chamber or the heat pump, wherein at least a portion of the water tank is configured to be inserted through the opening of the tank installation portion to thereby separably couple to the tank installation portion, wherein, based on the door being open and the water tank being coupled to the tank installation portion, at least a part of a front of the water tank is positioned at the opening and exposed to an outside, and wherein the water tank comprises:

a bottom part forming a bottom surface of the water-storage space;

a side part extending upward from the bottom part to form a side surface of the water-storage space;

a rear part extending upward from the bottom part to form a rear surface of the water-storage space;

an upper part extending forward from a top of the rear part to form an upper surface of the water-storage space, including a first portion that increases in height as it extends forward;

a front part forming a front surface of the water-storage space;

a grip formed in the front part; and a water hole formed at the upper part, wherein the water hole is formed at the first portion, wherein the clothes treatment apparatus further comprises:

a bar disposed at a front side of the tank installation portion and configured to, based on the water tank being coupled to the tank installation portion, be disposed at a lower portion of a front surface of the water tank, and wherein the water tank further comprises:

an engaging portion disposed at a lower part of a front side of the water tank, extending downward below the front surface of the water tank, and recessed rearward from the front surface of the water tank.

2. The clothes treatment apparatus according to claim 1, wherein the first portion is rounded.

3. The clothes treatment apparatus according to claim 1, wherein the water tank further comprises a water hole cover for opening and closing the water hole.

4. The clothes treatment apparatus according to claim 1, wherein the water tank further comprises a water supply check valve disposed at the bottom part and communicated with the steam unit when the water tank is coupled to the tank installation portion.

5. The clothes treatment apparatus according to claim 1, wherein the grip is disposed above a center of the front part of the water tank.

6. The clothes treatment apparatus according to claim 1, wherein the water tank further comprises:

an upper protruded portion protruding upward from a top of the front part.

7. The clothes treatment apparatus according to claim 1, wherein the water tank includes:

a tank body defining the bottom part, the side part, the rear part and the upper part; and a tank cover defining the front part, and coupled to a front of the tank body and defining the water-storing space with the tank body.

8. The clothes treatment apparatus according to claim 7, wherein the water tank further comprises:

a decorative cover coupled to the tank cover and configured to cover a front of the tank cover.

9. The clothes treatment apparatus according to claim 1, wherein the water tank comprises:

a water supply tank mountable separably on any one of a left side or a right side of the tank installation portion, for (i) supplying water to the steam unit based on the water tank being connected to the steam unit; and a drainage tank mountable separably on the other one of the left side or the right side of the tank installation portion, for (ii) storing condensed water generated in the treatment chamber or the heat pump.

10. The clothes treatment apparatus according to claim 9, wherein the water tank further comprises a decorative cover, and wherein an upper end of the decorative cover is located higher than an upper end of a tank cover.

* * * * *